US010024623B2

(12) United States Patent
Elkins et al.

(10) Patent No.: US 10,024,623 B2
(45) Date of Patent: Jul. 17, 2018

(54) REMOTE CONTROLLED ANIMAL DART GUN

(76) Inventors: Dan Elkins, Santa Fe, NM (US); Jesse Carwile, Grants, NM (US); Karen Herman, Santa Fe, NM (US)

( * ) Notice: Subject to any disclaimer, the term of this patent is extended or adjusted under 35 U.S.C. 154(b) by 350 days.

(21) Appl. No.: 13/235,862

(22) Filed: Sep. 19, 2011

(65) Prior Publication Data

US 2012/0069189 A1 Mar. 22, 2012

Related U.S. Application Data

(60) Provisional application No. 61/384,291, filed on Sep. 19, 2010.

(51) Int. Cl.
*F41B 11/00* (2013.01)
*F41B 11/57* (2013.01)
*F41B 11/85* (2013.01)

(52) U.S. Cl.
CPC ..... *F41B 11/57* (2013.01); *F41B 11/85* (2013.01)

(58) Field of Classification Search
CPC ..... F41B 11/57; F41B 11/00; F41B 11/52; A63B 69/409; A63B 2069/402
USPC ..... 348/158, 159; 124/56, 81–92
See application file for complete search history.

(56) References Cited

U.S. PATENT DOCUMENTS 3,266,806 A * 8/1966 Warren et al. ..... 473/581
3,525,319 A * 8/1970 Waldeisen ..... 124/58
4,155,342 A * 5/1979 Traweek ..... F41B 7/003 119/805
4,819,609 A * 4/1989 Tippmann ..... F41B 11/54 124/48
4,823,674 A * 4/1989 Nilsson ..... F41G 3/06 235/411
5,383,442 A * 1/1995 Tippmann ..... F41A 29/02 124/73
5,499,619 A * 3/1996 Tarta ..... 124/57
5,718,214 A * 2/1998 Altman et al. ..... 124/62
5,962,806 A * 10/1999 Coakley ..... F42B 12/36 102/293
6,414,713 B1 * 7/2002 Ebisawa ..... G02B 27/02 348/131
6,901,689 B1 * 6/2005 Bergstrom ..... F41A 25/20 42/1.06
7,795,263 B2 * 9/2010 Lance ..... A61K 9/0019 514/253.01
8,123,637 B1 * 2/2012 Demko et al. ..... 473/578
(Continued)

*Primary Examiner* — Shan E Elahi
(74) *Attorney, Agent, or Firm* — V. Gerald Grafe

(57) ABSTRACT

The present invention provides methods and apparatuses related to applying darts, such as tranquilizers and inoculations, to animals, and more particularly to such application in conditions where human presence in proximity to the animal is undesirable. Example embodiments of the present invention allow darts to be projected to animals while a human operator controls the device from a remote location. The remote location of the human operator reduces the need to chase or otherwise stress the animals. Inclusion of a human operator, as compared to fully automatic systems, reduces the chance of projecting darts to wrong targets such as incorrect species, reduces the chance of malfunction or damage to the system, and provides an ability to monitor in real time the application and effect of the darts.

13 Claims, 9 Drawing Sheets

(56) References Cited

U.S. PATENT DOCUMENTS

| | | | | |
|---|---|---|---|---|
| 2002/0040783 | A1* | 4/2002 | Zimmerman | B63G 8/001 166/366 |
| 2002/0053278 | A1* | 5/2002 | Hayes | B63C 9/26 89/1.34 |
| 2002/0178901 | A1* | 12/2002 | Bergstrom | F41A 25/20 89/198 |
| 2005/0262994 | A1* | 12/2005 | McNulty, Jr. | F41H 13/0025 89/1.11 |
| 2006/0284841 | A1* | 12/2006 | Hong et al. | 345/157 |
| 2008/0054570 | A1* | 3/2008 | Potterfield et al. | 273/403 |
| 2008/0181590 | A1* | 7/2008 | Radwill et al. | 392/385 |
| 2009/0098958 | A1* | 4/2009 | Miner | F42B 12/387 473/570 |
| 2009/0244700 | A1* | 10/2009 | Meyers | G02B 23/16 359/430 |
| 2009/0249677 | A1* | 10/2009 | Lalor | A01K 15/021 43/1 |
| 2009/0267895 | A1* | 10/2009 | Bunch | G06F 3/0386 345/157 |
| 2010/0010006 | A1* | 1/2010 | Lance | A61K 9/0019 514/253.01 |
| 2010/0203122 | A1* | 8/2010 | Weyer et al. | 424/456 |
| 2013/0118418 | A1* | 5/2013 | Lalor | A01K 15/021 119/720 |

* cited by examiner

REMOTE CONTROLLED ANIMAL DART GUN

CROSS REFERENCE TO RELATED APPLICATIONS

The present invention claims priority as a nonprovisional of U.S. provisional application 61/384,291, filed Sep. 19, 2010, which is incorporated herein by reference.

FIELD OF THE INVENTION

The present invention relates to applying darts, such as tranquilizers and inoculations, to animals, and more particularly to such application in conditions where human presence in proximity to the animal is undesirable.

BACKGROUND

Management of animals where capture is impossible or inconvenient can be done with darts fired into the animals from a distance. Such darts can be used to tranquilizing, for immunizing, for taking of biopsies, and other purposes. Conventional darting of animals generally involves human stalking or chase, and gunpowder-fired dart guns. These methods are expensive due to manpower and time required, and can cause significant stress on the animals, and can be difficult since considerable effort and skill can be required for a human to approach close enough to a wild animal for a reliable dart shot.

As one example, wild Horses and Burros on public lands are managed due to competition for limited forage from private livestock. Since passage of the 1971 Wild Free Roaming Horses and Burros Act, the primary "management" method to control population numbers of these animals has been round up via helicopter chase and other chase methods and removal from public lands. Helicopters round ups are expensive and result in injury and death to the animals. Relying on removing horses and burros from the wild has resulted in approximately 30,000 wild horses and burros being held in long term holding facilities, creating a financial crisis for the Bureau of Land Management (BLM). A more humane and sustainable management method is administering Porcine Zona Pellucida (PZP), an immunocontraceptive that can be used to control wild horse and burro reproduction. Cost-effectively administration of PZP in the wild has proven to be difficult.

Accordingly, there is a need for dart projection technology that allows for the remote darting of animals in the wild, for example of wild horses and burros with PZP, providing for a more safe, humane, and cost-effective management method.

BRIEF DESCRIPTION OF THE DRAWINGS

The accompanying figures are incorporated into and form part of the specification, and, with the specification, illustrate example embodiments of the present invention.

DETAILED DESCRIPTION OF THE PRESENT INVENTION

The present invention provides methods and apparatuses related to applying darts, such as tranquilizers and inoculations, to animals, and more particularly to such application in conditions where human presence in proximity to the animal is undesirable. Example embodiments of the present invention allow darts to be projected to animals while a human operator controls the device from a remote location. The remote location of the human operator reduces the need to chase or otherwise stress the animals. Inclusion of a human operator, as compared to fully automatic systems, reduces the chance of projecting darts to wrong targets such as incorrect species, reduces the chance of malfunction or damage to the system, and provides an ability to monitor in real time the application and effect of the darts.

Figure 1:
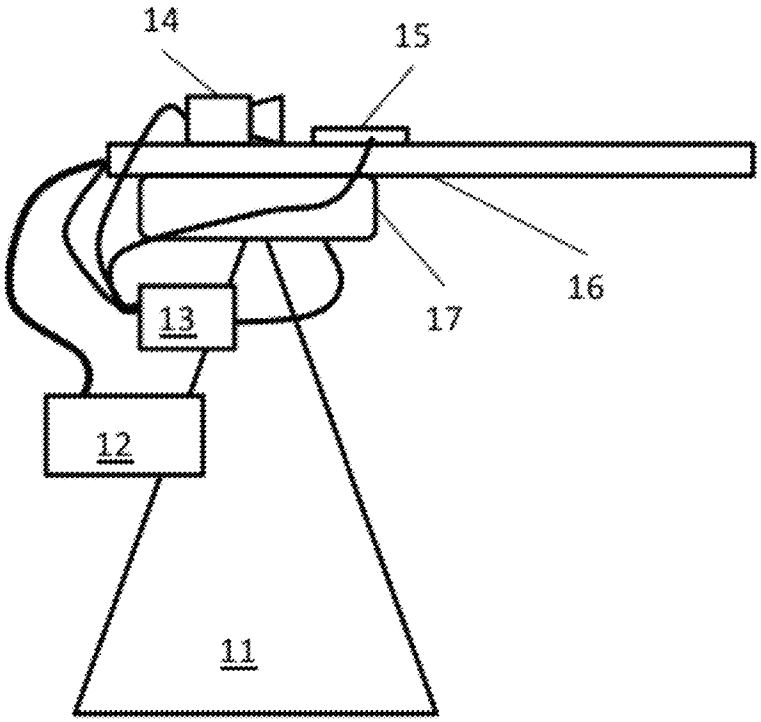
FIG. 1 is a schematic depiction of an example embodiment of the present invention.

FIG. 1 is a schematic illustration of an example embodiment of the present invention. A stable base 11 is configured for positioning on ground such as dirt or rock. A moveable element 17 mounts with the stable base such that the moveable element 17 can be configured at various angular relationships to the stable base 11; e.g., by rotation about one or more axes relative to the stable base 11. One or more barrels 16 mount with the moveable element 17. The one or more barrels 16 are configured to accept darts suitable for the intended use, such as tranquilizer darts, inoculation darts, biopsy darts, transmitter darts, and DNA sample darts. The one or more barrels 16 are in operative communication with a source of projection energy 12 such as compressed air. The source of projection energy 12 can mount with the stable base 11 as shown in the figure; the source of projection energy 12 can also mount with the moveable element 17 or with the ground, depending on size, weight, and strength characteristics desired.

A pointing device 15 such as a laser pointer mounts with the moveable element 17 such that the pointing device 15 indicates a point at a known relation to the expected impact of a dart projected through the barrel(s) 16, for example at a point coinciding with the expected impact point at a predetermined distance. A video device 14 mounts with the moveable element 17 such that the field of view of the video device 14 is in a known relationship to the expected impact of a dart projected through the barrel(s) 16; for example the field of view of video device 14 can include enough information to allow identification of an animal that will receive a dart, and can include the point indicated by the pointing device 15. A control system 13 is in communication with one or more of the moveable element 17, the video device 14, the pointing device 15, the source of projection energy 12, and the barrel(s) 16. The control system 13 is also configured to communicate information from the video device 14 with a remote human observer (not shown), and to accept control information from a remote human user (not shown).

Figure 2:
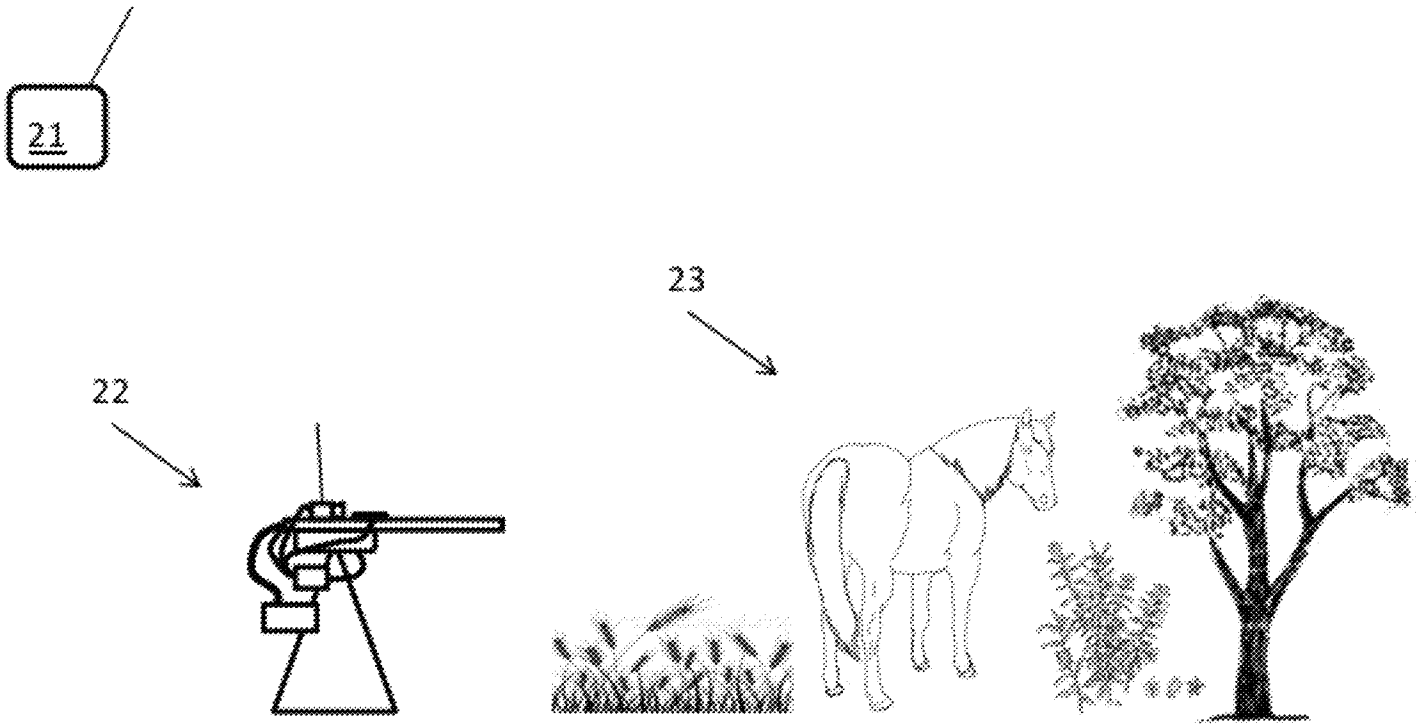
FIG. 2 is a schematic illustration of an example embodiment deployed for use.

FIG. 2 is a schematic illustration of an example embodiment of the present invention in use. An apparatus 22 like that depicted in FIG. 1 is placed at a location frequented by animals of interest. The apparatus 22 communicates via radio frequency communication over an antenna to a remote viewing monitor 21. A human operator can monitor the viewing monitor 21 and determine when an appropriate animal 23 is within range of the apparatus 22. The operator can communicate commands to the apparatus 22 to move the moveable element until the image in the viewing monitor indicates that the apparatus is aimed to deliver a dart to a desired part of the animal 23. The human operator can then send a command to the apparatus 22 to deliver the dart, for example by releasing a quantity of compressed air to blow the dart from the apparatus 22. The remoteness of the human operator can help avoid frightening the animal. The use of compressed air as a motive force for dart delivery can help avoid frightening the animal, or other animals in the vicinity, as would be the case with guns using gunpowder as a motive force. Remote communication in the figure is depicted as via radio communication; those skilled in the art appreciate that similar communications can be achieved using wires, fiber optics, or other technologies that allow communication at a distance.

Figure 3:
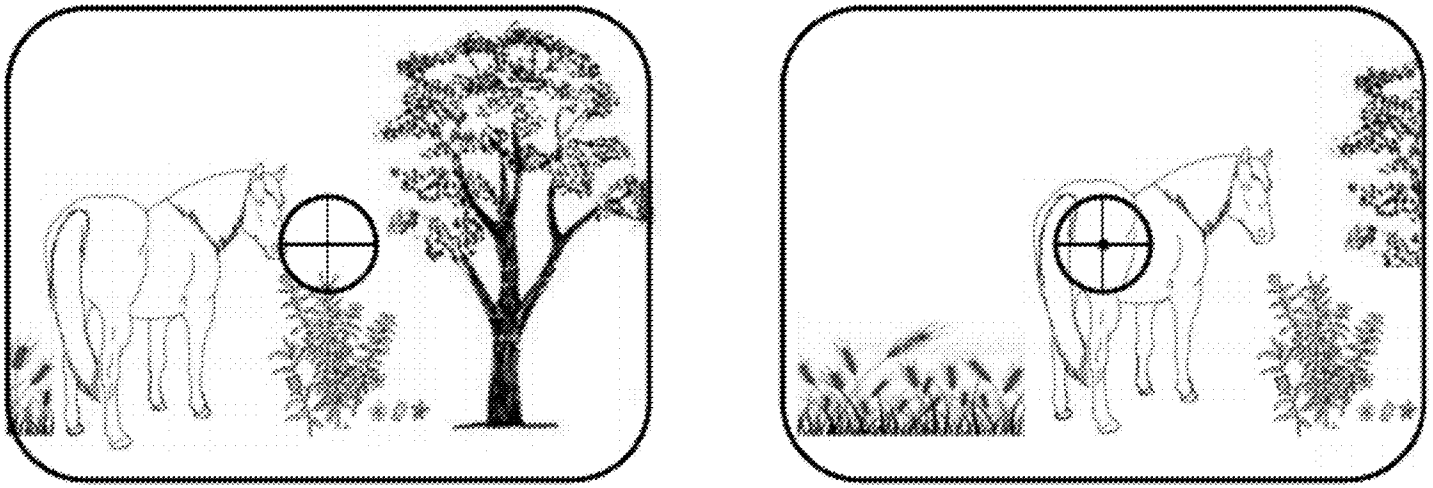
FIG. 3 is a schematic illustration of images obtained in use of an example embodiment.

FIG. 3 is a schematic illustration of two images representative of the operation of an example embodiment of the present invention. In the left image, the video device has transmitted to a remote user an image that shows an animal (a horse in the figure) present in the field of view. The apparatus is not pointed at the animal however; the crosshairs in the middle of the image indicate the point of impact of a dart. In the right image, the remote user has commanded the moveable element to move such that the expected impact point of a dart projected by the apparatus will strike the animal at a desirable location. A laser pointer mounted with the apparatus provides further confirmation of the expected impact point (the dark dot in the middle of the crosshairs). The crosshairs and pointer dot are for illustration only; other methods of indicating expected impact point can also be suitable; e.g., a pointer dot can be used without crosshairs; e.g., a characteristic of the display such as color or brightness can change when the apparatus is properly aimed. The apparatus can further include a range determination system such that the actual trajectory of a dart can be compensated for in the aiming, e.g., by elevating the effective aim point at greater distances.

The motion of the video device does not have to be coupled to the motion of the barrels at all times. For example, the video device can be moved separately, and a pointing device used to indicate the point of aim of the barrels. As another example, the video device can be moved separately, and an indicator provided in the video device of the point of aim of the barrels. Such separate motion can require more complex moveable elements and control, but can reduce the operating power (and therefore increase battery life) and can reduce motion and noise that can result from moving the barrels before required.

Figure 4:
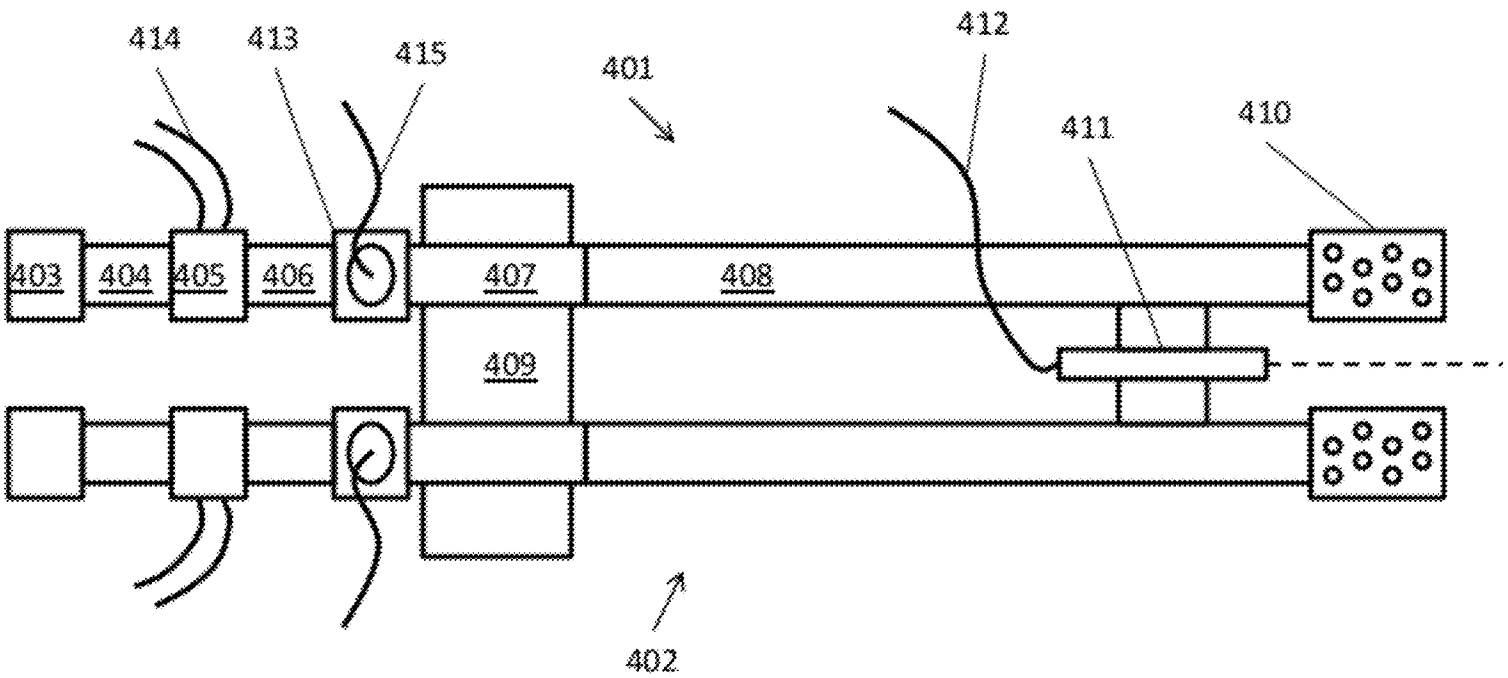
FIG. 4 is a schematic illustration of a barrel assembly suitable for use in an example embodiment.

FIG. 4 is a schematic illustration of an example barrel configuration suitable for use in the present invention, viewed from the top. The example configuration comprises first 401 and second 402 barrel assemblies. The presence of two barrels allows two darts to be projected at the same time, and allows two independent shots without requiring human intervention to reload. The example embodiment of FIG. 4 is for illustrative purposes; other barrel configurations, with one barrel or a plurality of barrels, in parallel or other relationships, and with various dart loading mechanisms such as magazine-fed loading, can all be compatible with the present invention.

The first and second barrels are similar; the description here will concern the first barrel. At a first end of the barrel is a cap 403, for example a ¾inch PVC pipe cap. A section 404 of tubing, for example ¾inch PVC pipe, sealingly mounts with the cap 403. A fitting 405 sealingly mounts with the tubing 404, where the fitting 405 is configured to accept compressed air through tubing 414. A section of tubing 406, for example ¾inch PVC pipe, sealingly mounts with the fitting 405. A control valve 413, for example a fast acting electrically controlled air valve, sealingly mounts with the tubing 406. The control valve 413 can be controlled via control wire 415 that communicates with a remote human user (not shown). Note that the various tubing sections are to facilitate construction, the components can be mounted directly to each other without intermediate tubing if the components have appropriate connection features, and the function of cap, fitting, and control valve can be accomplished with a single subassembly.

A section 407 of tubing, for example ¾inch metal pipe, sealingly mounts with the control valve 413. Metal pipe for this section of the barrel assembly can facilitate rigid mounting in relation to a moveable element (not shown) such as a pan/tilt head. Such rigid mounting can be accomplished by fastening the metal tubing to a plate or box 409 which in turns mounts to the moveable element. A further length of tubing 408 extends from the mounting section 407, providing length to the barrel as needed for accuracy and effective dart projection. The further length of tubing 408 can be formed as one piece with the mounting section 407 if weight and strength constraints allow. An optional tubing end 410, such as ½inch PVC pipe perforated with multiple holes, can mount with the end of the further tubing 408 to reduce noise (and consequent frightening and stress on the animals).

An optional pointing element 411, such as laser pointer, can mount with the barrels such that the pointing element 411 indicates an expected impact point of a dart projected through the barrel. For example, the pointing element can be mounted with the barrels such that the pointing element projects a light beam substantially parallel to the barrels. The pointing element 411 can be always energized through an internal power supply such as a battery or through a power connection wire 412. The pointing device 411 can further be controlled, for example on/off, brightness, color (visible or infrared, e.g.), automatically or by direction from a remote user.

Figure 5:
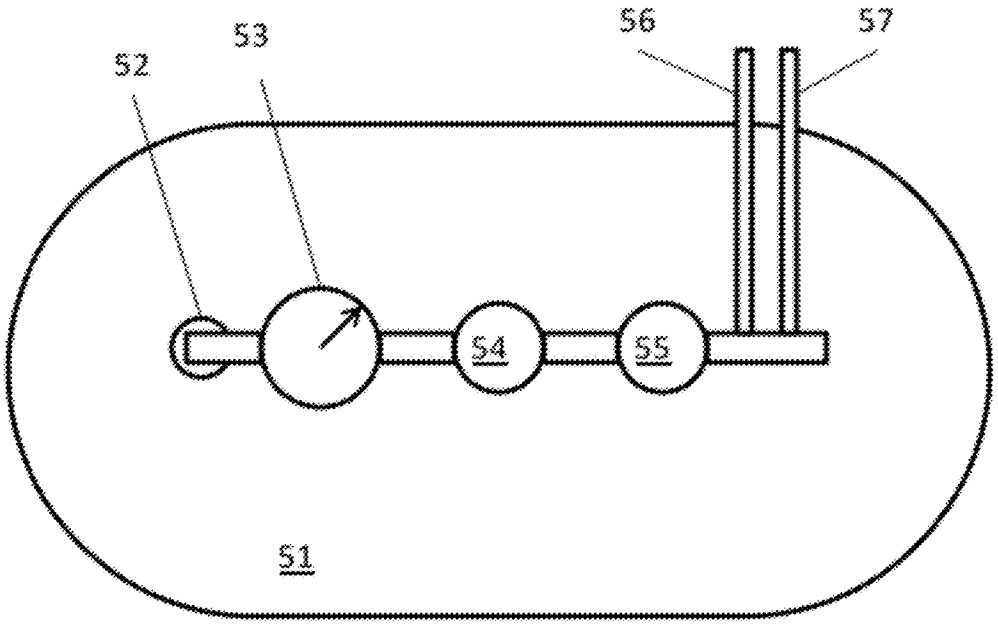
FIG. 5 is a schematic illustration of a compressed gas reservoir and control subsystem suitable for use in an example embodiment.

FIG. 5 is a schematic illustration of a pressurized air supply subsystem suitable for use with the present invention, for example with the two barrel example in FIG. 4. A pressure tank 51 is configured to store air or another gas at high pressure. A port 52 into the tank 51 allows communication of the pressurized gas with a gauge 53 that allows monitoring of the pressure. The gauge 53 is optional: the apparatus does not require a gauge although a gauge can be helpful in operating and maintaining the apparatus. The gauge 53 in the figure is depicted as an analog dial; digital readout, and communication to the remote human user, and go/nogo readouts can also be suitable. If the pressure in the tank 51 can vary, for example as the pressurized gas supply is consumed by multiple dart projections, then a regulator 54 in communication with the tank 51 can be useful to facilitate consistent operation of the barrels by providing consistent air pressure to the barrels. An air valve 55 can be connected between the tank 51 and the barrels (not shown) to allow the barrels to be isolated from the pressurized gas; for example to facilitate cleaning or loading of the barrels. Such a valve 55 can be a manual valve or can be remotely controlled such as by electric or pneumatic or hydraulic control. A remotely controlled valve can allow control from a remote human user, or under automatic control for safety or fault recovery, or to allow precise gas supply to the barrels by isolating the barrels from the tank 51 during firing of the barrels. Pressurized gas can be communicated to the barrels via pipes or tubes 56, 57; two are shown in the figure although one or more than two can be suitable depending on the number of barrels and configuration of gas flow paths at the barrels. Note that the gauge 53, regulator 54, and valve 55 might not be required for all embodiments, and that they can be mounted in various orders or in parallel with each other in some embodiments.

Electric control systems suitable for use in the present invention are known to those skilled in the art. Video capture and remote communication devices are commercially available. Remote control communication devices are also commercially available. All or part of the apparatus can be covered with camouflage coating, e.g., paint, or material, or netting, to reduce impact on the animals of interest. Components and subsystems can also be chosen for low noise operation to further reduce the likelihood that operation of the apparatus will frighten the animals. Agents that mask, remove, or obscure odors can be used after installation of the apparatus to further reduce the likelihood that presence of the apparatus will frighten the animals.

An apparatus as described herein can be deployed in a region frequented by animals of interest. As an example, an apparatus can be deployed where animals desired for temporary tranquilization are known to frequent (e.g., for capture, tagging, measurement, or study). As an example, an apparatus can be deployed where animals whose inoculation is desired are known to frequent (e.g., inoculation of wild animal populations against disease, or for administration of reproduction-inhibiting agents to humanely reduce animal populations). Images or video from the apparatus can be reviewed remotely by a human operator. Image processing methods can be used to reduce the need to constant human monitoring, for example motion detection or image recognition techniques can be used to alert the human operator that an animal might be in view. Real time video communication and remote control of the apparatus can be continuous, or can be enabled when the motion detection or image recognition at the apparatus indicates, or can be enabled by action of the remote operator.

The operator can inspect the image or video, and can control the moveable element to pan and/or tilt and/or zoom the video device to better inspect the area. If it is determined that an animal of interest is present, the operator can control the barrel(s) to aim at an appropriate site on the animal, for example by a sight indicator on the video or by alignment with a pointing device such as a laser pointer illumination of the expected point of impact. The operator can then initiate projection of a dart, for example by controlling release of air pressure into one or more barrels. The operator can monitor the video to determine whether the dart projection was successful, e.g., if the animal was in fact tranquilized, or if a subsequent dart projection is indicated. The operator can go to the apparatus for maintenance, e.g., if recharging of the compressed gas supply is needed, or for manual reloading of barrels (or magazines if the apparatus is magazine-fed), or for removing obstructions or repairing damage.

Figure 6:
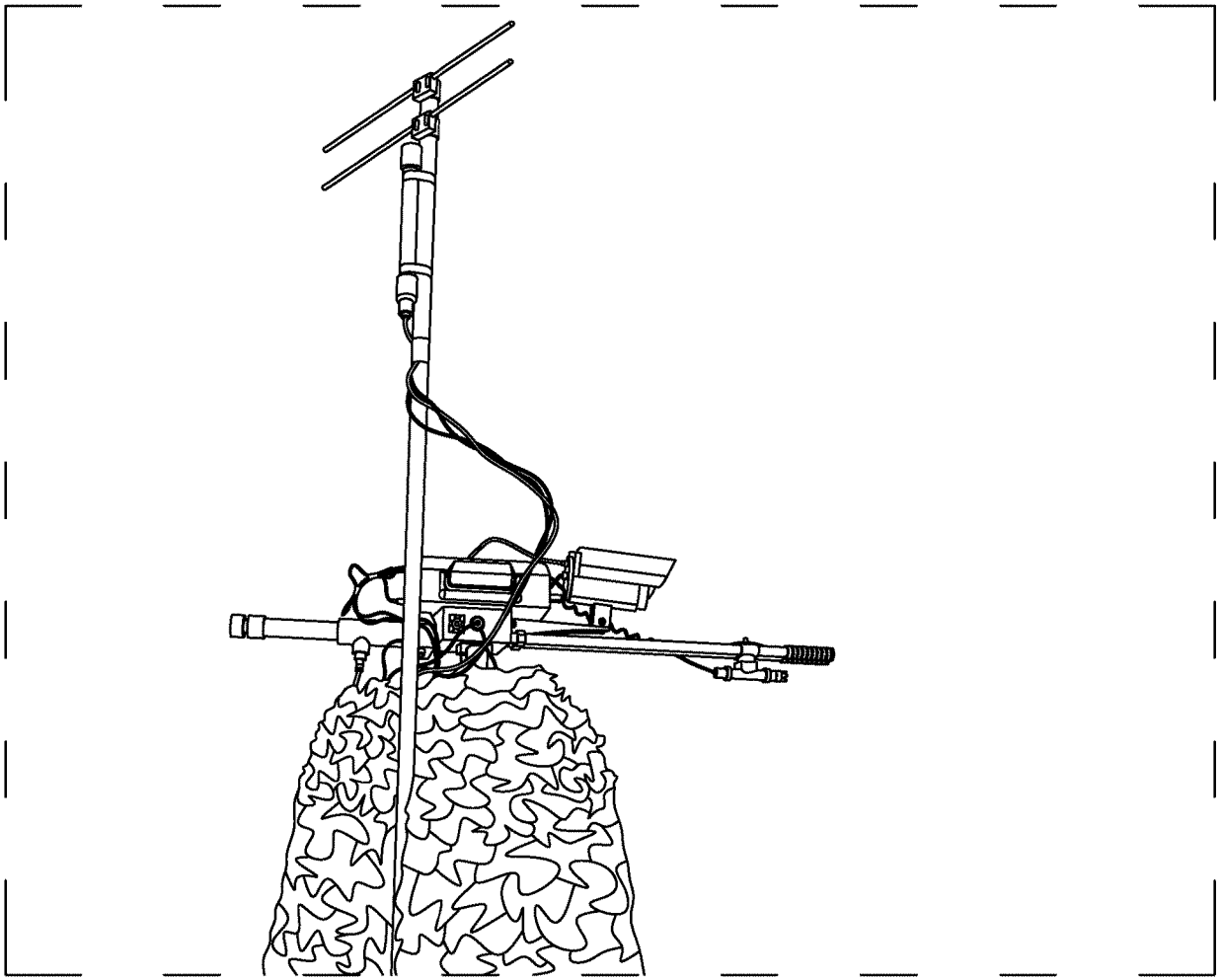
FIG. 6 is a photograph of an example embodiment.
Figure 7:
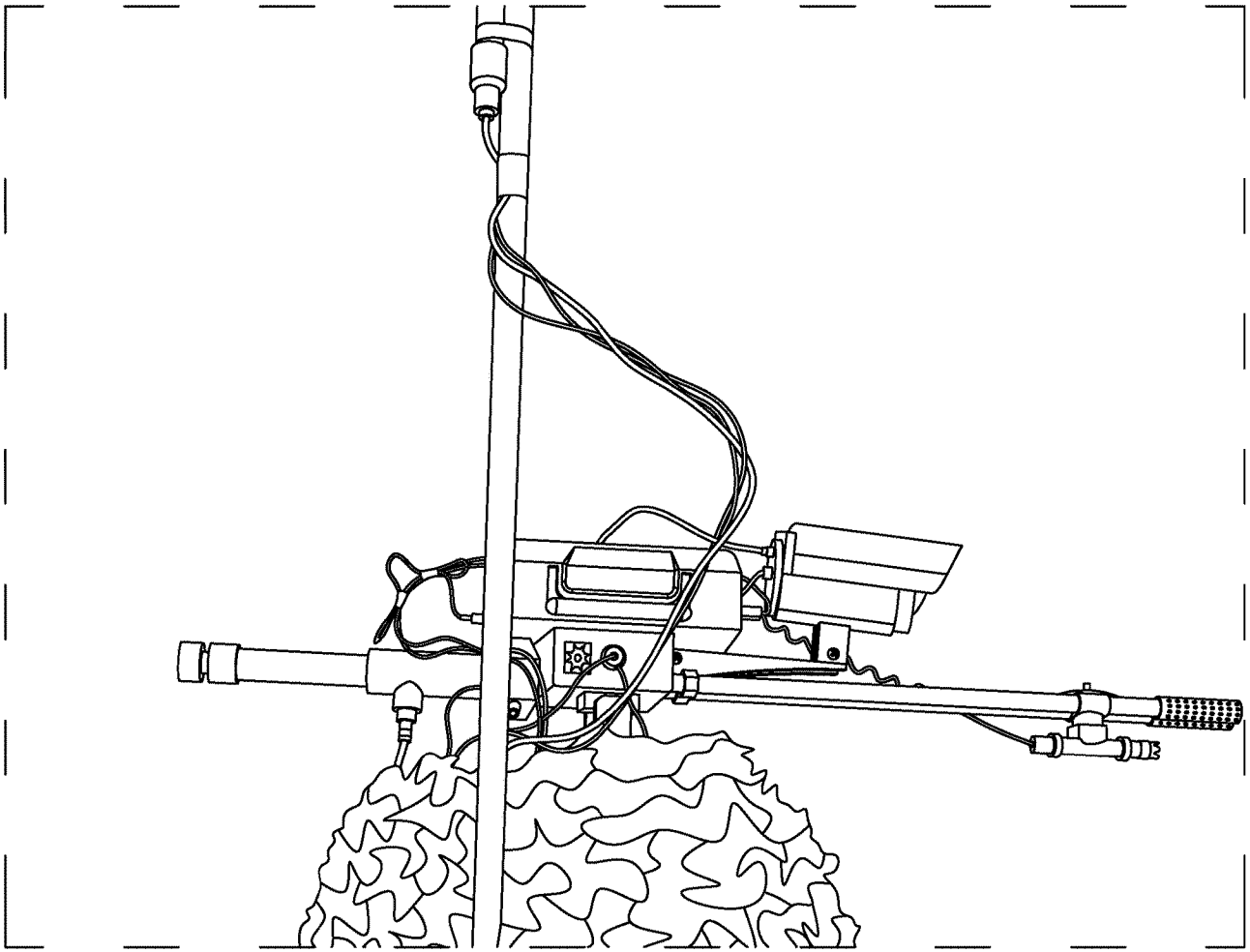
FIG. 7 is a photograph of an example embodiment.

FIG. 6 and FIG. 7 are photographs of an example embodiment. The stable base, moveable element, a battery, and a source of compressed gas are obscured by camouflage material and accordingly not clearly visible in the photographs. An antenna enabling remote communication extends above the rest of the apparatus. A two barrel system like that described previously mounts with the moveable element. A pointing device mounted below and between the two barrels. A video camera mounts above the two barrels with a viewing axis substantially parallel to the firing axes of the barrels. Wires for electrical communication and control connect the various elements as needed. Tubes for communication of compressed gas extend from the barrels to the compressed gas supply.

Figure 8:
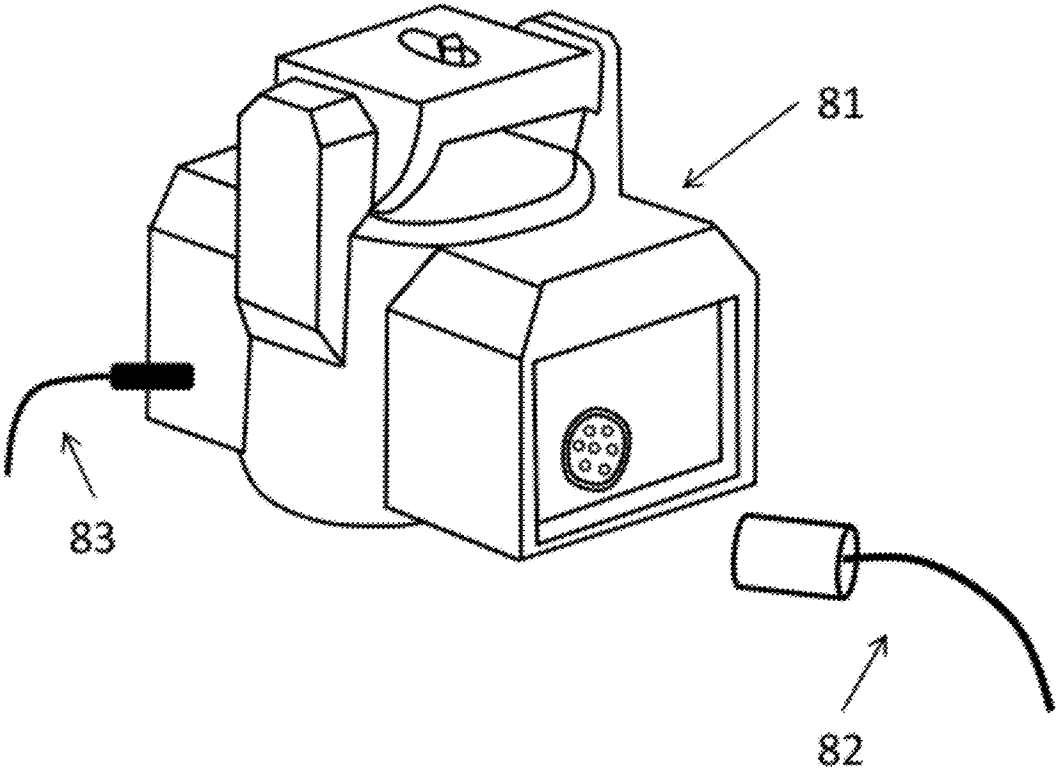
FIG. 8 is a schematic illustration of a commercially available motorized tilt head 81 suitable for use in example embodiments of the present invention.

FIG. 8 is a schematic illustration of a commercially available motorized tilt head 81 suitable for use in example embodiments of the present invention. Such heads typically require input DC power, for example at 6V or 12V. An adapter (not shown) is generally supplied, which converts 110V AC power to the DC power required by the head. The adapter can be removed and the DC power input 83 connected to a DC power supply such as a battery. A controller interface (not shown) is also typically supplied, with various buttons to control the motion of the head. The controller interface can be removed, and the interface plug 82 connected to control wires for remote control of the head.

Figure 9:
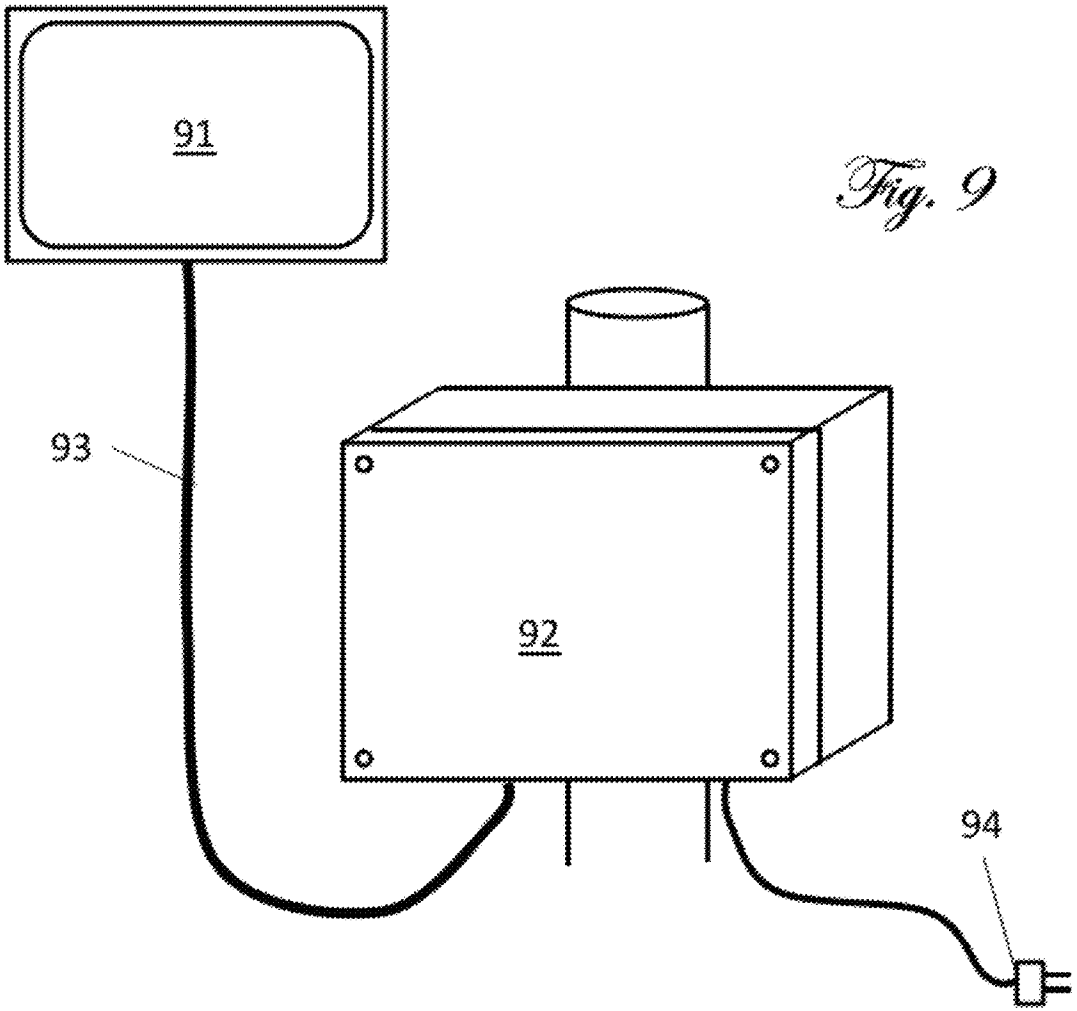
FIG. 9 is a schematic illustration of a video display subsystem suitable for use in example embodiments of the present invention.

FIG. 9 is a schematic illustration of a video display subsystem suitable for use in example embodiments of the present invention. A video communications system 92 is configured to receive video information from a camera mounted with a moveable unit (not shown). Video signals are transmitted from the communications system 92 to a monitor 91 (e.g., a television monitor or computer display) via a video cable 92 (e.g., using any of the various video connection and cable standards). The video system can be powered by readily available electrical power, e.g., by a plug 94 for connection to conventional AC electrical power.

The present invention has been described in the context of various example embodiments as set forth herein. It will be understood that the above description is merely illustrative of the applications of the principles of the present invention, the scope of which is to be determined by the claims viewed in light of the specification. Other variants and modifications of the invention will be apparent to those of skill in the art.

What is claimed is:

1. An apparatus for remote controlled projection of darts into animals, comprising:

(a) a stable base;

(b) a moveable element mounted with the stable base and configured to allow motion in at least one dimension;

(c) a dart projection subsystem mounted with the moveable element, configured to project a dart along a predictable trajectory, and a dart mounted therein, wherein the dart has a distal tip configured to penetrate the skin of an animal and wherein the dart is without a tether to the apparatus;

(d) a video capture device mounted with the stable base or the moveable element, configured to collect one or more video images;

(e) a communications subsystem, configured to transmit video information from the video capture device to a remote user, and to accept direction from the remote user to move the moveable element and to fire the dart projection subsystem.

2. The apparatus as in claim 1, wherein the video capture device comprises a video camera.

3. The apparatus as in claim 1, wherein the communications subsystem comprises wireless transmitter and receiver.

4. The apparatus as in claim 1, further comprising a pointing device mounted with the moveable element such that the pointing device indicates a point visible to a remote user that has a predetermined relationship to the expected impact point of the dart projection subsystem.

5. The apparatus as in claim 4, wherein the pointing device comprises a laser.

6. The apparatus as in claim 1, wherein the stable base comprises a tripod.

7. The apparatus as in claim 1, wherein the moveable element is rotatable about an axis not parallel to the surface on which the stable base mounts, and wherein rotation of the moveable element affects the trajectory of the dart.

8. The apparatus as in claim 1, wherein the moveable element is rotatable about a roughly vertical axis, and wherein rotation of the moveable element affects the trajectory of the dart.

9. The apparatus as in claim 1, wherein the moveable element is rotatable about two mutually perpendicular axes, and wherein rotation of the moveable element affects the trajectory of the dart.

10. The apparatus as in claim 1, wherein the moveable element comprises a pan/tilt head, and wherein the position of the moveable element affects the trajectory of the dart.

11. An apparatus for remote controlled projection of darts into animals, comprising:

(a) a stable base;

(b) a moveable element mounted with the stable base and configured to allow motion in at least one dimension;

(c) a dart projection subsystem mounted with the moveable element, configured to project a dart along a predictable trajectory, and a dart mounted therein, wherein the dart has a distal tip configured to penetrate the skin of an animal and where the dart is without a tether to the apparatus, wherein the dart projection subsystem comprises a source of compressed gas operatively connected to one or more barrels configured to eject a dart when compressed gas is applied;

(d) a video capture device mounted with the stable base or the moveable element, configured to collect one or more video images;

(e) a communications subsystem, configured to transmit video information from the video capture device to a remote user, and to accept direction from the remote user to move the moveable element and to fire the dart projection subsystem.

12. The apparatus as in claim 11, wherein the video capture device is mounted with the moveable element such that the expected impact point of the dart projections subsystem is at a predetermined location in the field of view of the video capture device.

13. A method of injecting a substance into a target animal, comprising:

(a) supplying an apparatus comprising:

(a1) a stable base;

(a2) a moveable element mounted with the stable base and configured to allow motion in at least one dimension;

(a3) a dart projection subsystem mounted with the moveable element, configured to project a dart along a predictable trajectory, and a dart mounted therein, wherein the dart has a distal tip configured to penetrate the skin of an animal and wherein the dart is without a tether to the apparatus;

(a4) a video capture device mounted with the stable base or the moveable element, configured to collect one or more video images;

(a5) a communications subsystem, configured to transmit video information from the video capture device to a remote user, and to accept direction from the remote user to move the moveable element and to fire the dart projection subsystem;

(b) monitoring the video information transmitted by the communications subsystem to determine when a desired target animal is within an effective range of the dart projection subsystem;

(c) when a desired target animal is within the effective range, then moving the moveable element according to direction from a user remote from the dart projection subsystem such that a predicted trajectory of a dart projected from the dart projection subsystem will impact the target animal;

(d) firing the dart projection subsystem according to direction from a user remote from the dart projection subsystem and thereby projecting the dart into the target animal.

* * * * *